United States Patent [19]

Wehmeyer

[11] 4,084,544

[45] Apr. 18, 1978

[54] HOLDER AND OPERATING TABLE FOR SWINE AND OTHER ANIMALS

[76] Inventor: Richard L. Wehmeyer, R.F.D. No. 1, Creighton, Mo. 64739

[21] Appl. No.: 735,066

[22] Filed: Oct. 22, 1976

[51] Int. Cl.[2] ..... A61D 3/00

[52] U.S. Cl. ..... 119/103

[58] Field of Search ..... 119/103, 98, 99

[56] References Cited

U.S. PATENT DOCUMENTS

| | | | |
|---|---|---|---|
| 117,072 | 7/1871 | Hause et al. | 119/98 |
| 652,103 | 6/1900 | Ground et al. | 119/99 |
| 970,344 | 9/1910 | Mills | 119/103 |
| 1,377,833 | 5/1921 | Hoisington | 119/103 X |
| 2,804,046 | 8/1957 | Turner | 119/99 |
| 3,051,127 | 8/1962 | Norbury | 119/98 X |

*Primary Examiner*—Hugh R. Chamblee

*Attorney, Agent, or Firm*—Clarence A. O'Brien; Harvey B. Jacobson

[57] ABSTRACT

An animal handling and operating table formed by a side wall of a chute which is mounted for pivotal movement about a substantially horizontal axis. Downward and upward swinging of the side wall is controlled by a biasing arrangement connected to the side wall and to a stand that elevates the chute above a support surface on which the chute is resting. The animal is restrained initially in the chute by a head gate including a head stock adjustably mounted at a head end of the chute for pivotal movement across the end of the chute, and which is selectively restrained against movement by a lock arm that engages teeth provided in an extension of the head stock from its pivotal mounting on a framework of the chute.

1 Claim, 4 Drawing Figures

HOLDER AND OPERATING TABLE FOR SWINE AND OTHER ANIMALS

BACKGROUND OF THE INVENTION

1. Field of the Invention

This invention relates generally to animal handling apparatuses, and particularly to a holder and operating table for use in vaccinating and castrating swine and other domestic animals.

2. Description of the Prior Art

There has long been a need for a device which facilitates handling of pigs and like animals while performing various operations on the animals. Generally, these devices include a chute disposed at ground level and having a head stock at the head end and side walls at the chute forming a swing-down operating table and an exit gate, respectively. Examples of such arrangements can be found in prior U.S. Pat. Nos. 151,048, issued May 19, 1874 to J. M. Overshiner, et al.; 970,344, issued Sept. 13, 1910 to F. H. Mills, and 2,521,487, issued Sept. 5, 1950 to H. H. Seyler. Other prior patents showing related structures include: 134,707, issued Jan. 7, 1873 to A. M. Scott, et al.; 427,145, issued May 6, 1890 to W. J. Bogard; and 469,558, issued Feb. 23, 1892 to P. Fricker, Jr.

SUMMARY OF THE INVENTION

It is an object of the present invention to provide an animal handling and operating table of simple yet rugged and reliable construction.

It is another object of the present invention to provide an animal handling and operating table elevated above the ground or other support surface so as to eliminate bending over by a person operating on the animal, and making it easier to catch an animal in a head gate of the device due to the elevation deterring the animal from lunging at or through the head holding arrangement.

It is still another object of the present invention to provide an animal handling and operating table in the form of a hinged floating surface for preventing drops of the table from its vertical position to its horizontal position and requiring relatively little effort for an operator to lower and raise the table even with an animal strapped thereto.

It is yet another object of the present invention to provide an animal handling and operating table having associated therewith a head holding device of simple yet rugged and reliable construction.

These and other objects are achieved according to the present invention by providing an animal handling and operating table including a chute comprising a frame, a first side wall, a second side wall spaced from and disposed substantially parallel to the first side wall, and a head gate disposed for selectively retaining an animal passing between the first side wall and second side wall, with the first side wall being pivotally mounted for a vertical swing upwardly and downwardly and forming an operating table when swung to a downward position, and the second side wall having a portion adjacent the head gate being pivoted for forming a side gate permitting an animal to exit the chute, the improvement wherein the first side wall is a floating table provided with an arrangement biasing against a downward swing for preventing a sudden drop of the first side wall when an animal is retained on that wall and for assisting an operator in swinging the first side wall upwardly with the animal still retained thereon.

The first side wall is advantageously provided with a leg disposed extending perpendicularly from the wall at the axis of swinging of the one side wall relative to the frame of the chute. A stand supports the frame of the chute above a surface supporting the device so that not only is the table placed in a convenient position for use when the first side wall is swung to its downward position, but the biasing arrangement is permitted to be conveniently disposed beneath the chute.

According to a preferred embodiment of the invention, the arrangement which biases the first side wall against downward swinging movement includes two tension springs, each of which springs is attached to and extend between the stand and a substantially common point on the leg of the first side wall. The common point on the leg is spaced from the first side wall itself, and the springs are disposed diverging from one another as they extend from the leg to retaining structure of the stand.

Appropriate ramps are provided for permitting an animal to climb up to the chute and subsequently be permitted to return to the surface supporting the chute from the side gate provided in the second side wall of the chute.

The head gate according to the invention includes a head frame on which a stanchion or head stock is pivotally mounted at the head end of the chute. A retaining arm extends from the head stock in the direction radially away from the pivot point of the head stock, and is provided with a plurality of teeth which are selectively engaged by a lock arm pivotally mounted on the head frame for selectively engaging one of the teeth of the retaining arm and restraining the head stock against movement away from a position retaining an animal within the head gate. The locking arm can be readily manipulated as by the hand of a operator in order to restrain and release the animal as desired.

These together with other objects and advantages which will become subsequently apparent reside in the details of construction and operation as more fully hereinafter described and claimed, reference being had to the acompanying drawings forming a part hereof, wherein like numerals refer to like parts throughout.

DESCRIPTION OF THE PREFERRED EMBODIMENTS

Figure 1:
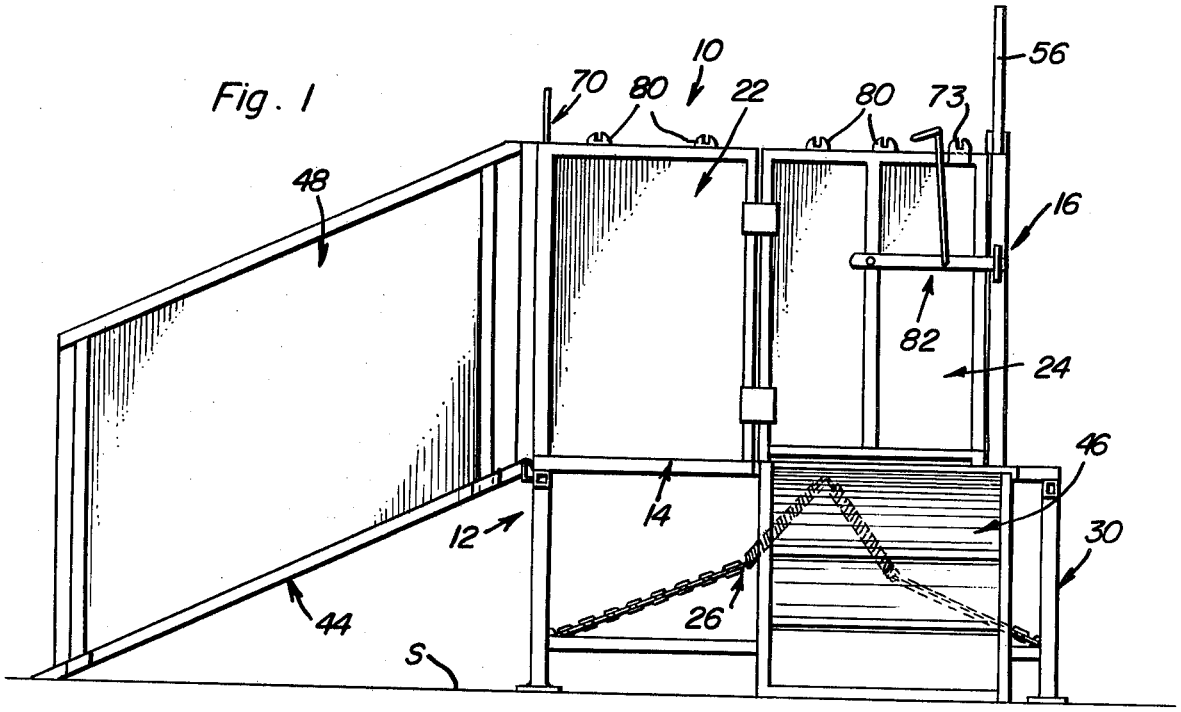
FIG. 1 is a side elevational view showing an animal handling operating table assembly according to the present invention.
Figure 2:
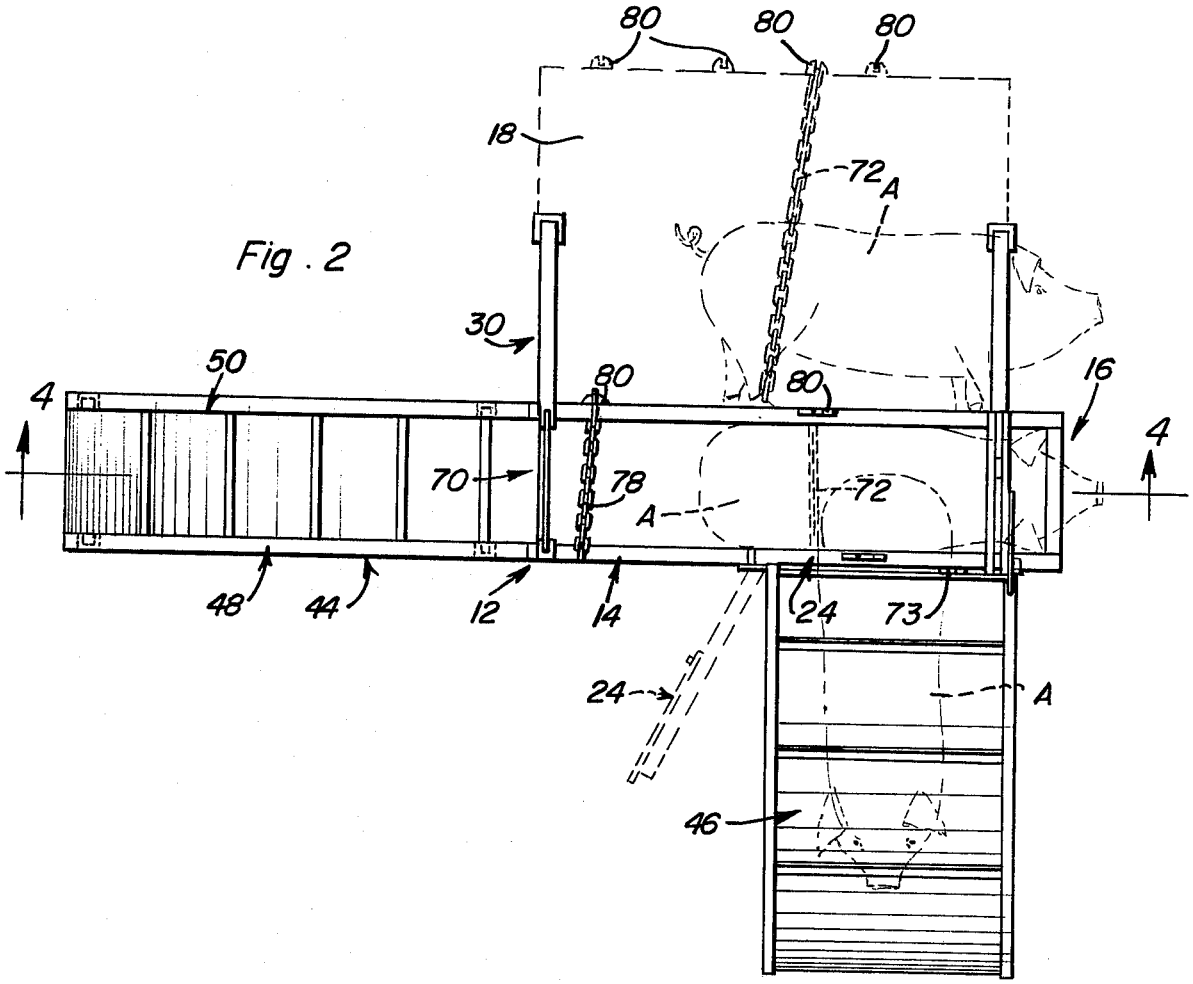
FIG. 2 is a top plan view showing the assembly of FIG. 1.

Referring now more specifically to the four figures of the drawings, an animal handling and operating table assembly 10 according to the invention includes a chute 12 comprising a framework 14, a head gate 16 disposed at the head end of the chute 12, a first side wall 18 extending along one lateral side of chute 12 and mounted for vertical swinging movement about a horizontal rail 20 partially forming framework 14, and a second side wall 22 spaced from and disposed substantially parallel to first side wall 18 in order to form a passage between the walls 18 ad 22. The pivotal mounting of wall 18 permits same to swing vertically upwardly and downwardly so as to form an operating table when wall 18 is swung downward into a substantially horizontal plane. Wall 22 has a portion thereof disposed adjacent the head gate 16 pivoted on suitable hinges so as to form a side gate 24 which permits exit of an animal A after the requisite operations have been performed. First side wall 18 forms a floating table and for this purpose is provided with a biasing arrangement 26 which biases wall 18 against its downward swing for preventing a sudden drop of wall 18 when an animal A is restrained on wall 18, and for assisting an operator (not shown) to swing the wall 18 between its upward, or substantially vertical, position and its downward, or substantially horizontal, position.

First side wall 18 is floor or leg 28 forming a bottom of chute 12 and disposed extending substantially perpendicularly from the associated side wall 18 at the axis of swinging of wall 18 as defined by rail 20. A stand 30 of suitable construction supports the framework 14 of chute 12, with the biasing arrangement 26 being attached to and extending between stand 30 and a point on leg 28 spaced from the plane of side wall 18. In particular, elevation of chute 12 by use of stand 30 not only places the table formed by side wall 18 at a suitable height for performing various operations on an animal A when side wall 18 is swung into its downward position, as shown by broken lines in FIG. 3, but the elevation of chute 12 makes it easier to restrain an animal A within head gate 16 due to the hesitancy of an animal A to jump from the bottom of chute 12, as defined by leg 28 when the side wall 18 is disposed in a substantially vertical plane, to the support surface S on which the assembly 10 is disposed.

Biasing arrangement 26 includes two coiled tension springs 32 and 34, each attached to and extending between stand 30 and a substantially common point on leg 28. More specifically, springs 32 and 34 are connected to respective chains 36 and 38 which in turn are anchored to space uprights 40 and 42 of stand 30. Further, springs 32, 34 are substantially connected to one another by an eye attached to the outermost portion of leg 28 so as to be spaced a maximum distance from the plane of first side wall 18. Further, the springs 32 and 34 by their attachment to the uprights 40 and 42 diverge from one another as they extend from their point of attachment of leg 28 toward their respective uprights 40 and 42 in order to ensure that even forces are applied to first side wall 18 during its swinging movements.

An on-ramp 44 extends from the level of support surface S on which stand 30 is resting to the bottom of chute 12 for permitting an animal A to ascend to chute 12. As mentioned above, leg 28 of first side wall 18 normally forms a bottom of chute 12 on which an animal A can pass forwardly to the head end of chute 12 and be restrained by actuation of head gate 16. In a similar manner, an off-ramp 46 extends to support surface S from frame 12 adjacent the lower portion of side gate 24 so as to permit an animal A to descent from chute 12 to support surface S upon completion of an appropriate operation on the animal A. It has been found expedient to provide the on-ramp 44 with a pair of spaced, substantially parallel side curtains 48 and 50 disposed along lateral portions of the on-ramp 44 for blocking the animal's view as same ascends the on-ramp 44.

As can be appreciated from the drawings, the on-ramp 44 is retained on the lip of a channel partially forming stand 30, while side curtains 48 and 50 are removably attached to the on-ramp 44 itself by self-locking connections using techniques known per se.

Head gate 16 comprises a head frame 52 partially forming the framework 14 and having pivotally mounted thereon a stanchion or head stock 54. The pivot 56 of head stock 54 is disposed in any one of a plurality of holes 58 arranged extending along the lower portion of head frame 52. A retaining arm 60 extends from head stock 54 radially away from the pivot 56, and is provided with a plurality of teeth 62 which are selectively engaged by a lock arm 64 pivotally mounted on head frame 52 so as to prevent the head stock 54 from pivoting away from a position retaining an animal within the head frame 52.

Head stock 54 is also provided with a concave curved portion 66 for receiving a section of the neck of an animal A, and has mounted thereon a shield 68, partially forming the curved portion 66, fastened to the head stock 54 for adjusting with pivotal movement of head stock 54 and blocking the portion of the head frame 52 not occupied by an animal A being restrained.

In operation, an animal A is brought up the on-ramp 44 and along leg 28 forming the bottom of chute 12 so as to be brought into head frame 52. An entrance gate 70 can now be brought into position behind the animal A so as to block exit of the animal from chute 12. This gate 70 can slide between uprights of framework 14 at the entrance to chute 12 by manual manipulation. Once the head of animal A is disposed in head frame 52, head stock 54 may be pivoted into position by manipulation of arm 71 and locked in animal holding position by engagement of lock arm 64 with one of the teeth 62 provided on the retaining arm 60. Once restrained by the head gate 16, the animal A may be further held down against the side wall 18 as by a chain 72 attached to lug 80 on wall 18 at a one end and having its other end provided with an eye 74 which selectively engages in one of a plurality of apertures 76 provided along the longitudinal extent of wall 18 adjacent the pivot axis of wall 18. Chain 72 can be held in holder 73 when animal A enters the chute. This adjustment permits chain 72 to be placed in proper position relative to animals of various size. An opposed side wall 18 may now be unlatched as by releasing a chain 78 disposed in one of a set of lugs 80 provided on side wall 18.

Figure 3:
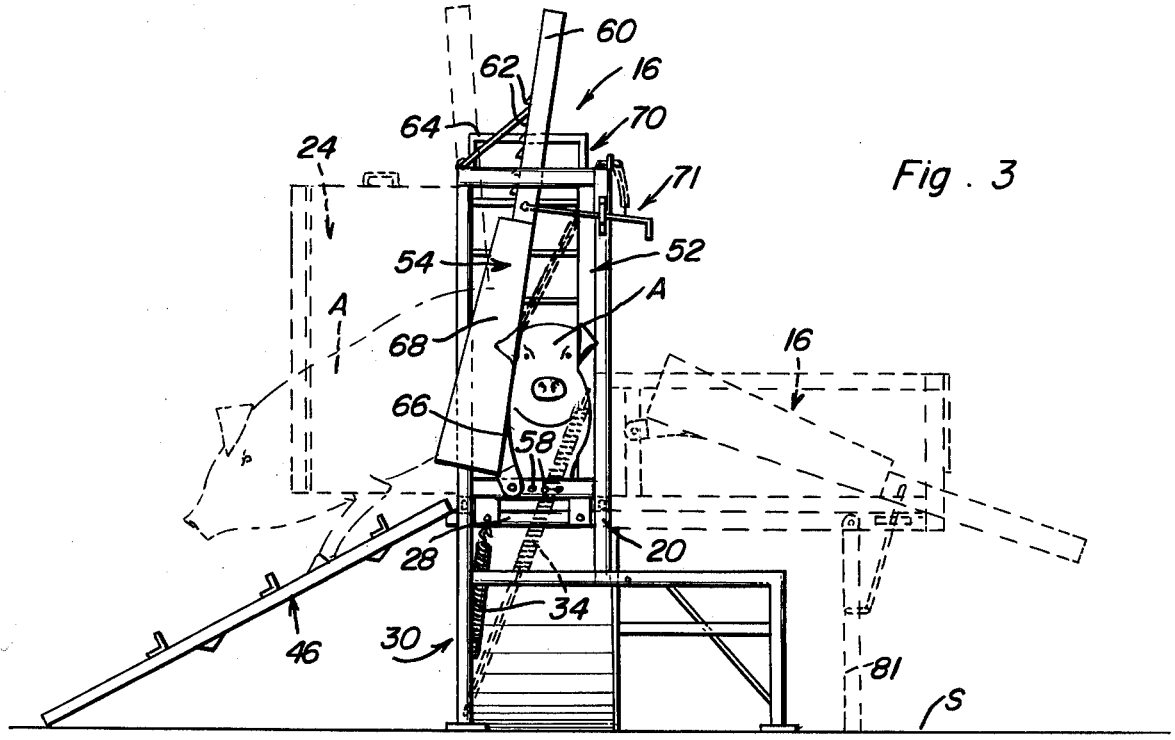
FIG. 3 is an end elevational view showing the assembly as seen from the right of FIG. 1.
Figure 4:
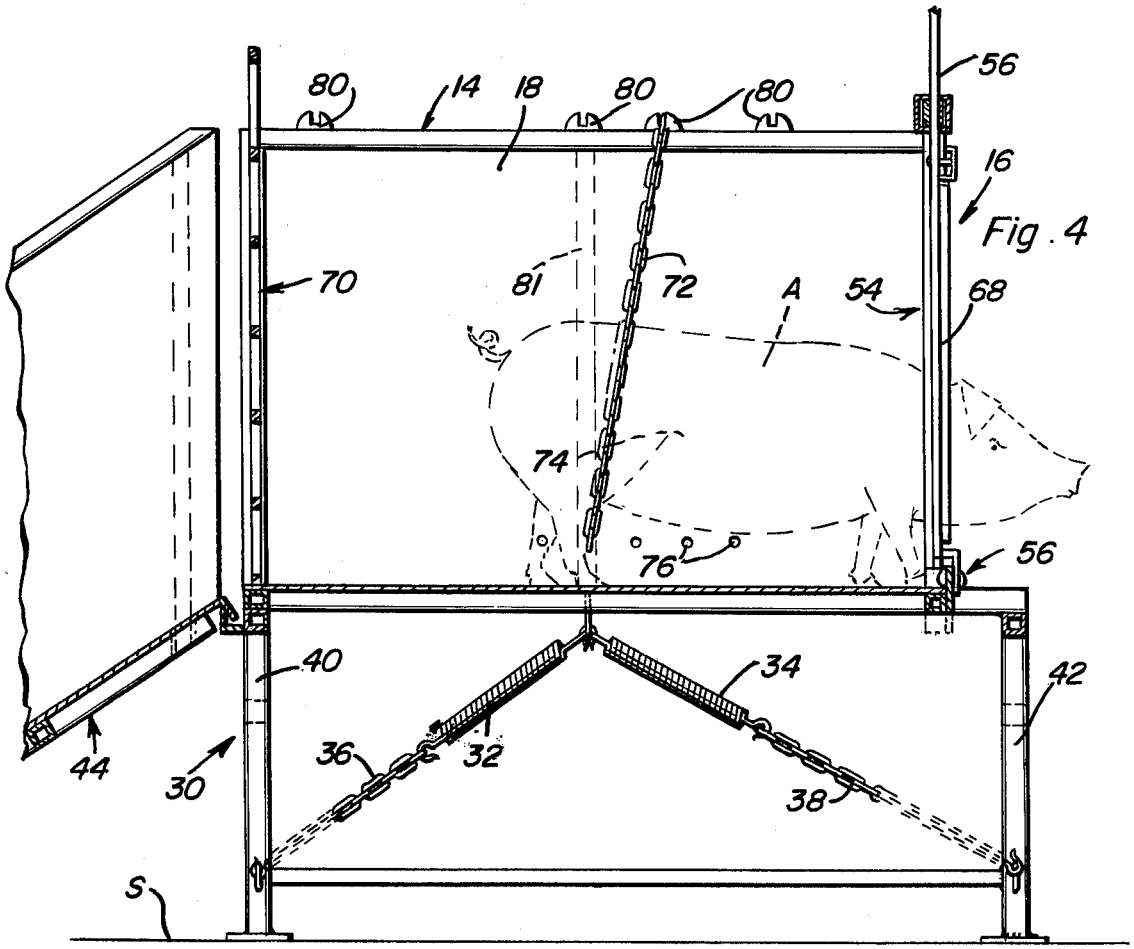
FIG. 4 is an enlarged, fragmentary, sectional view taken generally along the line 4—4 of FIG. 2.

Once side wall 18 is released, it can be swung down to the broken line position shown in FIG. 3 under the weight of animal A and against thebias of arrangement 26. As wall 18 swings down, a leg 81 will pivot outwardly of the lower surface of side wall 18 so as to perform a support for the table.

When the operation is finished, side wall 18 can be swung back to its vertical position, as shown in full line in the drawings, and secured in its normally vertical position by means of the chain 78. The animal A may now be released from the chain 72 and head gate 16, with the head gate being brought across the head end of chute 12 so to prevent the pig from exiting in that direction, and the side gate 24 opened by manipulation of a suitable latch assembly 82 in order to permit the animal A to exit chute 12 by means of the off-ramp 46. The above procedure may now be repeated.

As will be appreciated from the above description and from the drawings, an animal handling and operating table assembly according to the invention provides a simple yet efficient and easily employed device for performing necessary operations on swine and similar animals.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an animal handling and operating table including a chute comprising a framework including a first side wall, a second side wall spaced from and disposed substantially parallel to the first side wall, and a floor affixed to the first side wall, and a head gate affixed to the first side wall and disposed for selectively restraining an animal between the first side wall and second side wall, the first side wall being pivotally mounted for vertical swinging movement upwardly and downwardly and forming an operating table when in a downward position, and the second side wall having a portion adjacent the head gate being pivoted for forming a side gate permitting an animal to exit following an operation thereon, the improvement wherein the first side wall is a floating table provided with means for biasing the wall against a downward swing for preventing a sudden drop of the first side wall when an animal is retained on the first side wall, and for assisting an operator in swinging the first side wall upwardly and downwardly, the floor being a solid sheet and disposed extending perpendicularly from the first side wall at the axis of swinging of the first side wall, and a stand supporting the framework on the chute, an on-ramp extending from the level of the support surface on which the stand is resting to the chute for permitting animals to ascend from the chute, the floor forming a solid bottom for the chute when the first side wall is in an upward position, and an off-ramp extending from the support surface to the side gate of the second side wall for permitting an animal to descend from the chute, the means for biasing including two tension springs normally disposed beneath the chute, each attached to and arranged extending between the stand from adjacent the support surface and a substantially common point on the floor of the first side wall, the substantially common point being spaced from the first side wall and the springs diverging from one another from the substantially common point on the floor toward the stand for exerting a torque on the first side wall, the head gate comprising a head frame disposed at a head end of the chute and attached to the first side wall for movement therewith, a head stock pivotally mounted at an adjustable pivot on the head frame, a retaining arm extending from the head stock and provided with a plurality of teeth, and a lock arm pivotally mounted on the framework of the chute for selectively engaging one of the teeth of the retaining arm and preventing the head stock from moving away from a position restraining an animal in the head gate, and animal retaining means including a flexible element removably attachable to the first side wall about an animal for holding the animal against the first side wall.

* * * * *